United States Patent [19]

Colletta et al.

[11] 4,056,443

[45] Nov. 1, 1977

[54] COKE PRODUCTION

[75] Inventors: Angelo Colletta; Luigi Palumbo, both of Rome, Italy

[73] Assignee: Centro Sperimentale Metallurgico S.p.A., Rome, Italy

[21] Appl. No.: 659,580

[22] Filed: Feb. 19, 1976

[30] Foreign Application Priority Data

Feb. 19, 1975 Italy ..... 48246/75

[51] Int. Cl.[2] ..... C10B 47/24; C10B 49/10; C10B 53/04; C10B 57/04

[52] U.S. Cl. ..... 201/5; 201/8; 201/21; 201/29; 201/31; 201/36; 201/37; 201/44

[58] Field of Search ..... 201/5, 6, 8, 14, 28, 201/29, 31, 36, 38, 44

[56] References Cited

U.S. PATENT DOCUMENTS

| | | | |
|---|---|---|---|
| 2,131,702 | 9/1938 | Berry | 201/6 |
| 2,734,851 | 2/1956 | Smith | 201/36 |
| 3,051,628 | 8/1962 | Gorin et al. | 201/5 |
| 3,051,629 | 8/1962 | Gorin et al. | 201/5 |
| 3,073,751 | 1/1963 | Gorin et al. | 201/5 |
| 3,076,751 | 2/1963 | Minet | 201/31 |
| 3,414,480 | 12/1968 | Stotler et al. | 201/8 X |
| 3,565,766 | 2/1971 | Eddinger et al. | 201/28 X |

FOREIGN PATENT DOCUMENTS

| | | | |
|---|---|---|---|
| 258,940 | 10/1970 | U.S.S.R. | 201/44 |

*Primary Examiner*—Morris O. Wolk
*Assistant Examiner*—Michael S. Marcus
*Attorney, Agent, or Firm*—Young & Thompson

[57] ABSTRACT

Coke is produced with high yield and low sulfur by heating and drying ground coking coal at 200° to 300° C. for 15 to 120 minutes in air, and then heating in three semicoking stages in fluidized bed reactors. The first semicoking stage is 300° to 470° C. for 10 to 20 minutes; the second is 400° to 600° C. for 10 to 20 minutes; while the third is 800° to 1100° C. for 10 to 20 minutes. Tar is condensed from the offgases of the first two semicoking stages and the residual gas from each is divided and 60 to 80% recycled as fluidizing gas to the same semicoking reactor. 10 to 20% of the offgases from the third semicoking stage is recycled to the third stage as fluidizing gas. In addition, oxygen is used as make-up fluidizing gas in each of the three stages, in the amount of 10 to 30 liters per kilogram of dry coal in the first stage, 5 to 20 liters per kilogram of dry coal in the second stage, and 40 to 100 liters per kilogram of dry coal in the third stage. The offgas from the third stage is high in reducing power. The condensed tar is fed to the final coke-forming operation.

2 Claims, 1 Drawing Figure

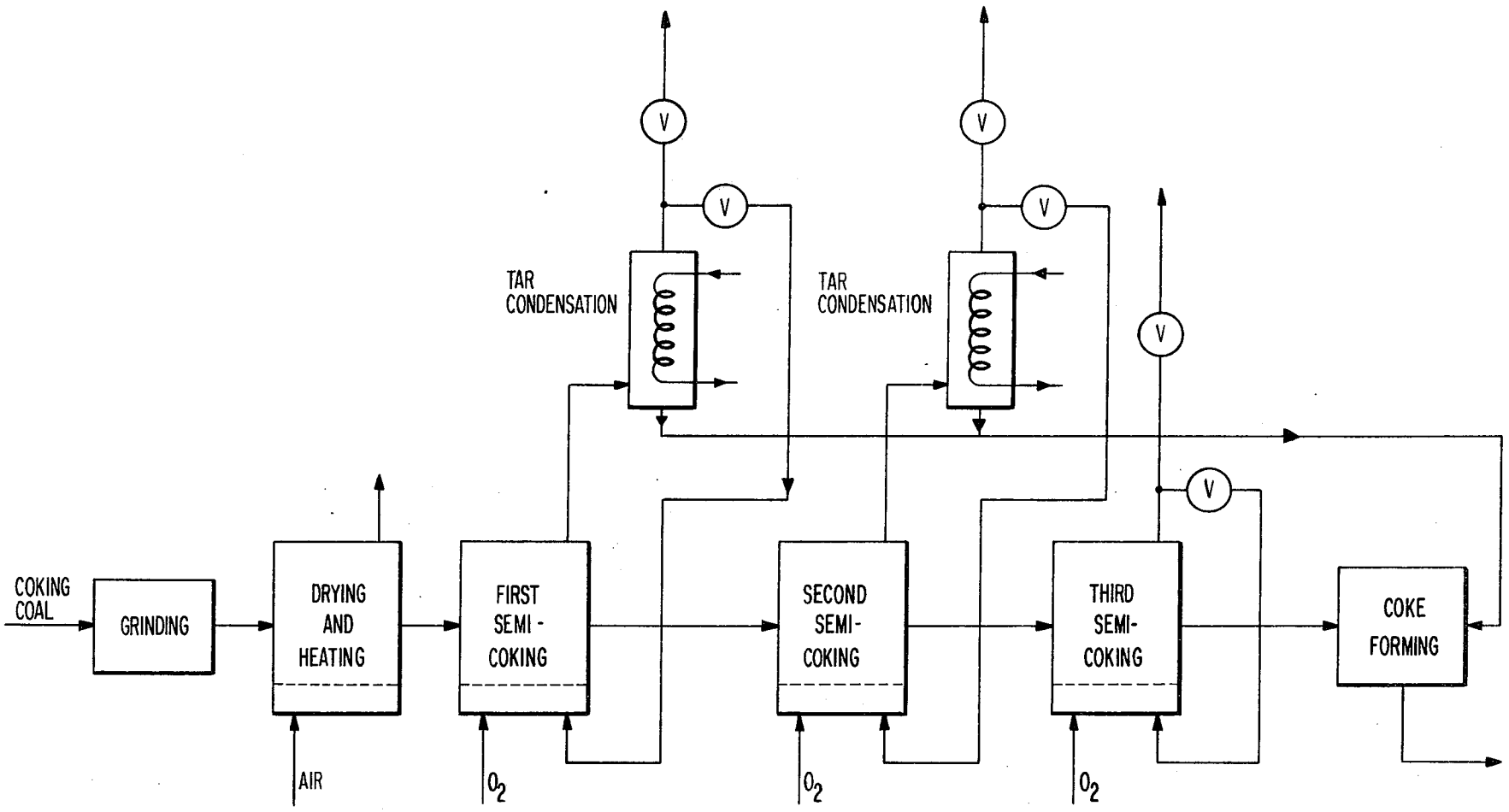
COKING COAL
GRINDING
DRYING AND HEATING
AIR
FIRST SEMI-COKING
$O_2$
SECOND SEMI-COKING
$O_2$
THIRD SEMI-COKING
$O_2$
COKE FORMING
TAR CONDENSATION
TAR CONDENSATION
V

COKE PRODUCTION

The present application is an improvement on our conpending application Ser. No. 528,393, filed Nov. 29, 1974, now abandoned.

The present invention relates to coke production by continuous multistage fluidized bed techniques.

In known coke producing processes of the continuous multistage fluidized bed type, the following steps are performed:

1. Grinding of the coal;

2. An oxidation phase characterized by heating of the ground coal in a fluidized bed in the presence of oxygen, to remove any cokifying and agglomerating potential and to create conditions for the formation of peroxides which favor the subsequent polymerization of the product;

3. Heating in a fluidized bed reactor at temperatures below 500° C., to eliminate some of the constituents of the coal which are driven off as vapors and condense as tar, the tar being subsequently used as a binder in the briquette-forming phase;

4. A calcination phase characterized by heating to temperatures of around 900° C. to eliminate the less volatile fractions;

5. Cooling of the thus-obtained semicoke to temperatures such as to prevent ignition of the material upon contact with the air; and 6. A coke-forming phase characterized by briquette forming, hardening and baking.

However, these known techniques have not proven to be entirely satisfactory, since they give only a low yield from the raw material and also produce a coke which has a high sulfur content, which sulfur is of course detrimental in subsequent metallurgical uses of the coke.

Accordingly, it is an object of the present invention to provide methods for coke production, in which the yield is increased.

Another object is the provision of such methods in which the resulting coke has relatively low sulfur.

Still another object of the present invention is the provision of such methods that provide improved control of the temperature of the semicoking reactors.

Yet another object of the present invention is the provision of such methods in which at least some of the off-gases from the semicoking reactors have a high reducing power.

It is also an object of the present invention to provide such methods which impart to the semicoking plant the maximum flexibility in order to treat various kinds of coal.

The invention also has as an object the provision of such methods which avoid the agglomeration of coal particles during semicoking.

Finally, it is an object of the present invention to provide such methods which will be relatively easy and inexpensive to practice, and dependable in result.

Briefly, the objects of the present invention are achieved by providing continuous methods for coke production, characterized by the following steps, to be read in connection with the accompanying drawing which is a schematic flow diagram of the process according to the present invention:

1. Grinding;

2. Drying and heating in a fluidized bed reactor which is fluidized by any gas which is suitable as to availability, cost and safety, at temperatures between 200° and 300° C. for a period of 15 to 120 minutes. Examples of fluidizing gas are 50 to 100% by volume air, 0 to 50% by volume steam, and 0 to 50% by volume nitrogen, and a particular example is air. The offgases from this drying and heating step are vented owing to their leanness, that is, their low heating value;

3. A first semicoking step characterized by heating in a fluidized bed reactor with a makeup gas which is 10 to 30 normal liters of oxygen per kilogram of dry coal, at temperatures from 300° to 470° C. for a period of 10 to 20 minutes. The offgases from this first semicoking step are cooled to 15 to 95° C. to condense tars, the tars being then sent to the subsequent briquetting operation. The remaining gaseous mixture is divided and 60 to 80% by volume recycled to the first semicoking reactor, the remainder being collected for use in other processes in the metallurgical and chemical industries. The offgases from this first semicoking step have a volume composition of 5 to 20% hydrogen, 0.4 to 2% oxygen, 0.5 to 3% nitrogen, 30 to 50% methane, 8 to 25% carbon monoxide, 8 to 15% carbon dioxide, 2 to 7% ethane and 0.5 to 2.5% propane. Both the make-up gas and the recycled gas are used to fluidize the bed;

4. A second semicoking step characterized by heating in a fluidized bed reactor with the introduction of make-up gas which is oxygen in an amount of 5 to 20 normal liters per kilogram of dry coal, at a temperature of 400° to 600° C. for 10 to 20 minutes. The offgases from this second semicoking step are cooled to 15° to 90° C. to condense tars, the tars being sent to the subsequent briquetting operation. The remaining gaseous mixture is divided and 60 to 80% by volume recycled to the second semicoking reactor, the remainder being collected for use in other processes in the metallurgical and chemical industries. The offgases from this second semicoking step have the volume composition 40 to 58% hydrogen, 0.1 to 4% oxygen, 0.1 to 1% nitrogen, 5 to 10% methane, 20 to 55% carbon monoxide, and 2 to 8% carbon dioxide. Both the make-up gas and the recycled gas are used to fluidize the bed;

5. A third semicoking step characterized by heating in a fluidized bed reactor with the introduction of make-up gas which is oxygen in the amount of 40 to 100 normal liters per kilogram of dry coal, at a temperature of 800 to 1100° C. for 10 to 20 minutes. The offgases are divided and 10 to 20% thereof recycled to this third semicoking reactor, the balance being useful without further processing as a reducing agent in blast furnaces, in direct reduction plants or for any type of chemical process. In fact, the offgas from the third semicoking step consists essentially of hydrogen and carbon monoxide, the oxygen which is blown in having reacted with a portion of the particles of the solid carbonaceous material; and 6. Transformation of the semicoke into formed coke by conventional processes as above.

It will of course be understood that the unrecycled portion of the offgases from the semicoking steps is equal to the distillation gases from the respective steps because the amount of the fluidization gas is constant under steady or equilibrium conditions.

It is to be noted that, contrary to our above-identified application, the composition of the initial fluidizing gas, that is, that gas which is used for fluidization prior to the time the cycle is fully on-stream or operating at equilibrium, is of little or no consequence, it being possible to start from any initial fluidizing mixture suitable within limits of availability, cost and safety, e.g. air.

It will also be recognized that the present invention in effect separates what was the first semicoking step of the process of our earlier application identified above, into two initial semicoking stages. These stages are found to be more effective than a single initial semicoking step, because they give the plant maximum flexibility in order to treat every kind of coal and avoid the agglomeration of particles in the fluidized beds. If what is disclosed in the present application as the first and second semicoking steps are thus considered as a composite semicoking step, it being recognized that they both have in common tar condensation and 60 to 80% recycle of the offgases, it will thus be recognized that the range of temperature in this composite stage is 300° to 600° C., the range of time is 20 to 40 minutes, and the range of oxygen blown in as fluidizing gas is 5 to 30 normal liters per kilogram of dry coal.

It is also to be recognized that the use of oxygen as makeup gas in the semicoking steps keeps the temperature of all the semicoking reactors at the levels required for the correct operation of the process under steady state or equilibrium conditions, a result that was not previously achieved by preheating the fluidizing gas. The oxygen is consumed substantially completely, thereby supplying the heat required for establishing the temperature range in each reactor and more closely controlling this temperature. In this way, plant engineering requirements are also greatly simplified. Also, as pointed out above, the offgases from the third semicoking reactor have a remarkably high reducing power.

To enable those skilled in this art to practice the invention, the following illustrative example is given merely by way of illustration and not in any limitative sense:

EXAMPLE

Forty pounds per hour of a conventional coking coal containing 25% by weight of volatile matter, 0.64% sulfur and 6.23% ash is subjected to the following steps:

1. Grinding to a grain size between 16 and 150 mesh;

2. Heating and drying at 260° C. in a fluidized bed reactor supplied with air as make-up gas at a flow rate of 6.3 cubic meters per hour measured at 20° C. and 1.1 atmosphere absolute, for 30 minutes;

3. A first semicoking step at 400° C. in a fluidized bed reactor supplied with commercially pure oxygen as make-up gas at a flow rate, per kilogram of dry coal, which is 20 liters measured at 20° C. and 1 atmosphere absolute, for 15 minutes. The offgases from this reactor are cooled to 55° C. to condense tar which is sent to the subsequent briquetting operation. The residual gas is divided into two parts, and one part equal to 70% by volume is recycled to the first semi-coking reactor. The unrecycled portion collected for other uses as explained above;

4. A second semicoking step which is identical to the first, except that the temperature is 500° C. and the oxygen flow rate is 15 normal liters per kilogram of dry coal;

5. A third semicoking step at 870° C. in a fluidized bed reactor which is supplied with commercially pure oxygen at a flow rate of 70 normal liters per kilogram of dry coal measured at 20° C. and 1 atmosphere absolute, for 15 minutes. The offgases from this third reactor are divided into two parts, one of which is 15% by volume and is recycled to the third semicoking reactor and has a volume composition which is 47.2% hydrogen and 52.8% carbon monoxide; and 6. A conventional coke-forming operation in which the semicoke is cooled and blended with the tar and cold-briquetted and the green briquettes thus produced are hardened at 850° C. for 1 hour.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

Having described our invention, we claim:

1. A method of producing coke of low sulfur content, comprising grinding coking coal, drying and heating the ground coal at a temperature of 200° to 300° C. for 15 to 120 minutes by fluidizing the ground coal with gas thereby to produce a dried and heated material; passing said material to a first semicoking stage, heating said material by fluidization in said first semicoking stage at 300° to 470° C. for 10 to 20 minutes while supplying to said first semicoking stage a make-up fluidizing gas containing oxygen in a quantity of 10 to 30 normal liters per kilogram of dry coal, thereby to produce semicoke and first offgases; cooling said first offgases to produce condensed tar and first residual gases; recycling to said first semicoking stage as fluidizing gas 60 to 80% by volume of said first residual gases; passing the semicoke from said first semicoking stage to a second semicoking stage, heating the semicoke in said second semicoking stage at 400° to 600° C. for 10 to 20 minutes while supplying to said second semicoking stage a make-up fluidizing gas containing oxygen in a quantity of 5 to 20 normal liters per kilogram of dry coal, thereby to produce semicoke and second offgases; cooling said second offgases to produce condensed tar and second residual gases; recycling to said second semicoking stage as fluidizing gas 60 to 80% by volume of said second residual gases; passing the semicoke from said second semicoking stage to a third semicoking stage, heating the semicoke by fluidization in said third semicoking stage at 800° to 1100° C. for 10 to 20 minutes with the production of third offgases while supplying to said third semicoking stage a make-up fluidizing gas containing oxygen in a quantity of 40 to 100 normal liters per kilogram of dry coal; recycling to said third semicoking stage as fluidizing gas 10 to 20% by volume of said third offgases; and briquetting the semicoke from said third semicoking stage into formed coke.

2. A method as claimed in claim 1, which is continuous.

* * * * *